US009630818B2

(12) United States Patent
Cantoni et al.

(10) Patent No.: US 9,630,818 B2
(45) Date of Patent: Apr. 25, 2017

(54) COLLAPSIBLE HOISTING DEVICE FOR USE IN THE CONSTRUCTION OF LARGE METAL CONTAINERS, AND REMOVABLE ACCESSORY APPLICABLE THERETO

(71) Applicants: Marcelo Ricardo Cantoni, Santa Fe (AR); Sebastián Cantoni, Santa Fe (AR)

(72) Inventors: Marcelo Ricardo Cantoni, Santa Fe (AR); Sebastián Cantoni, Santa Fe (AR)

( * ) Notice: Subject to any disclaimer, the term of this patent is extended or adjusted under 35 U.S.C. 154(b) by 358 days.

(21) Appl. No.: 13/734,134

(22) Filed: Jan. 4, 2013

(65) Prior Publication Data

US 2013/0119332 A1 May 16, 2013

Related U.S. Application Data

(63) Continuation-in-part of application No. PCT/ES2011/070494, filed on Jul. 6, 2011.

(30) Foreign Application Priority Data

Jul. 7, 2010 (AR) ..... P20100102451

(51) Int. Cl.

| | |
|---|---|
| ***B66F 3/24*** | (2006.01) |
| ***B66F 1/02*** | (2006.01) |
| ***B66F 1/08*** | (2006.01) |
| *A62B 3/00* | (2006.01) |
| *E21D 15/44* | (2006.01) |

(52) U.S. Cl.

CPC ..... *B66F 1/025* (2013.01); *B66F 1/08* (2013.01); *A62B 3/005* (2013.01); *E21D 15/44* (2013.01)

(58) Field of Classification Search

USPC ..... 254/93 R

See application file for complete search history.

(56) References Cited

U.S. PATENT DOCUMENTS

| | | | |
|---|---|---|---|
| 2,657,009 A | 10/1953 | Neis et al. | |
| 3,709,467 A | 1/1973 | Mann | |
| 3,841,441 A | 10/1974 | Klinkhammer et al. | |
| 3,881,687 A | 5/1975 | Johansson | |

(Continued)

FOREIGN PATENT DOCUMENTS

| | | | |
|---|---|---|---|
| DE | 19501181 A1 * | 7/1996 | ..... B66F 19/00 |
| EP | 1947263 A1 * | 7/2008 | ..... E04B 1/35 |

(Continued)

*Primary Examiner* — Lee D Wilson
*Assistant Examiner* — Alvin Grant
(74) *Attorney, Agent, or Firm* — Hess Patent Law Firm LLC; Robert J. Hess

(57) ABSTRACT

A collapsible hoisting device for use in the construction of large metal containers and to a removable accessory applicable thereto. It facilitates construction procedures by reducing project times and costs. The collapsible device includes a column (2) along which respective upper bodies (6) and lower bodies (7) that have been inserted into said column (2) move. The bodies (6, 7) are linked by an extendable means (8). The upper bodies (6) and lower bodies (7) have a corresponding mechanism to lock or attach (9) to the column (2), The column (2) is mounted so that it pivots with respect to a base (1) and the upper body (6) has a housing (609) suitable for the insertion of a removable, fingernail-shaped accessory (12).

9 Claims, 8 Drawing Sheets

(56) References Cited

U.S. PATENT DOCUMENTS

| | | | | | |
|---|---|---|---|---|---|
| 4,067,448 | A | | 1/1978 | Bergeron, Jr. | |
| 4,109,975 | A | | 8/1978 | Mattson | |
| 4,377,915 | A | * | 3/1983 | Zossimas et al. | 40/785 |
| 4,462,383 | A | * | 7/1984 | Henke et al. | 126/21 A |
| 4,624,447 | A | | 11/1986 | Richmeier | |
| 5,553,352 | A | * | 9/1996 | Bolton | 16/229 |
| 5,634,539 | A | * | 6/1997 | Gordon | 190/24 |
| 5,722,798 | A | * | 3/1998 | Gregory | 405/230 |
| 6,033,246 | A | * | 3/2000 | Gilbert | 439/248 |
| 6,245,284 | B1 | * | 6/2001 | Cooper, Sr. | 266/61 |
| 7,500,592 | B1 | | 3/2009 | Petricio | |
| 7,607,865 | B2 | * | 10/2009 | Gregory et al. | 405/251 |
| 8,181,698 | B2 | * | 5/2012 | Springett et al. | 166/52 |
| 2005/0011998 | A1 | * | 1/2005 | Bombelli | 248/118.1 |
| 2010/0018131 | A1 | * | 1/2010 | Green | 52/79.5 |

FOREIGN PATENT DOCUMENTS

| | | | | |
|---|---|---|---|---|
| GB | 247674 | A | | 2/1926 |
| JP | 7109093 | A | | 4/1995 |
| WO | WO 2007048863 | A1 | * | 5/2007 |
| WO | WO 2012004442 | A3 | | 1/2012 |
| WO | WO 2012109825 | A1 | * | 8/2012 |

* cited by examiner

COLLAPSIBLE HOISTING DEVICE FOR USE IN THE CONSTRUCTION OF LARGE METAL CONTAINERS, AND REMOVABLE ACCESSORY APPLICABLE THERETO

CROSS-REFERENCE TO COPENDING PATENT APPLICATIONS

The present application is a continuation-in-part of international patent application PCT/ES2011/070494 filed Jul. 6, 2011, which in turns claims the benefit of priority from Argentinian patent application P20100102451 filed Jul. 7, 2010.

BACKGROUND OF THE INVENTION

1. Field of Invention

The present invention refers to a folding lifting device to be used in the construction of large metal containers, and a removable fitting applicable to such device. That is, to a collapsible hoisting device for use in the construction of large metal containers, and removable accessory applicable thereto. The characteristics of the present invention facilitate the construction procedures reducing construction time and costs.

2. Description of Related Art

It is known that in order to perform the assembly of various structures it is necessary to have a system that is able to lift part or the whole of the structure. In particular, for the construction of large metal tanks or containers applying the method which consists of constructing first a ring and the roof attached to it, and subsequently lifting the structure and attaching new rings, always working close to the floor, the use of devices able to lift the growing structure in a safe and effective way without disturbing the assembly process becomes critical.

Currently, in the present state of the art some of the disclosed lifting devices are limited in general to several models of hydraulic or mechanic jacks, which show drawbacks in their use that the present device has solved.

Among said jacks, those described in the U.S. Pat. No. 7,500,592 B1 (Yaksic) dated Mar. 10, 2009 describing the use of non-folding hydraulic jacks can be mentioned.

Spanish Utility model application ES 1045850 U (Carinox) dated Apr. 4, 2000 and Spanish patent ES 2 208042 B1 (Carinox) dated Feb. 28, 2005 disclose hydraulic jacks especially aimed at assembling and disassembling vertical tanks, which among other differences with the present invention, do not feature removable support fittings.

Regarding jacks layout, said U.S. Pat. No. 7,500,592 B1 (Yksic) discloses the use of three independent but coordinated hydraulic systems. Thus, the number of hydraulic jacks used must be a multiple of 3. Spanish patent ES 2 211 268 B1 (Cariñox) dated Mar. 8, 2005 describes the operating station for hydraulic systems of this type, whereas Spanish patent ES 2 213 436 (Cariñox) dated Jun. 29, 2005 shows a hydraulic lifting system for assembling and disassembling vertical tanks, where the hydraulic jacks are divided into groups of independent operation for the optimum control of structure verticality.

On the one hand, the lifting device must be able to grasp or hold the structure safely. To this purpose, the technologies known usually weld accessory supports in the structure as a kind of handles, that the jack uses as a lock or bearing point to support the structure during the lifting operations. On completion of the work, said supports must be removed, which requires considerable manpower and affects the work finishing.

On the other hand, the presence of a jack prevents operators from working freely. This detail is of vital importance in the construction of metal tanks, since it is crucial to ensure the welding quality of the layers constituting the walls of the container to guarantee the structure strength of the whole. In this case, the device supporting the structure while a new ring is assembled prevents automatic welding machines from being used.

Additionally, the device itself must be firmly placed, which in general, implies welding its base to the bottom of the tank with the subsequent expense of necessary resources to unweld it once the job is complete.

The device of the present invention solves all these problems, reducing the temporary welding necessary for assembly to the minimum and allowing its folding so as to allow improvement on the construction conditions of containers.

SUMMARY OF THE INVENTION

The invention relates to a collapsible hoisting device for use in the construction of large metal containers and to a removable accessory applicable thereto, characterized in that it facilitates construction procedures by reducing project times and costs. The collapsible device includes a column (2) along which respective upper bodies (6) and lower bodies (7) that have been inserted into said column (2) move, said bodies (6, 7) being linked by an extendable means (8), and said upper bodies (6) and lower bodies (7) having a corresponding means of locking or attaching (9) to said column (2); said column (2) being mounted so that it pivots with respect to a base (1) and said upper body (6) having a housing (609) suitable for the insertion of a removable, fingernail-shaped accessory (12).

That is, the invention relates to folding lifting device to be used in the construction of large metal tanks, and a removable fitting applicable to said device, the characteristics of which facilitate the construction procedures reducing construction time and costs. The folding lifting device comprises a column (2) on which the respective upper (6) and lower (7) bodies that are inserted in said column (2) move, being said bodies (6, 7) are linked by means of a tensile element (8), and said upper (6) and lower (7) bodies having a lock or fixing means (9) to said column (2); being said column (2) assembled in a pivot way regarding a base (1) and said upper body (6) having a housing (609) capable of permitting the insertion of a removable fitting with a pawl shape (12).

BRIEF DESCRIPTION OF THE FIGURES

The present invention is illustrated with schematic figures in its preferred embodiment as follows.

In all the figures already mentioned, equal reference numbers correspond to identical elements of the invention.

DETAILED DESCRIPTION OF THE INVENTION

Figure 1:
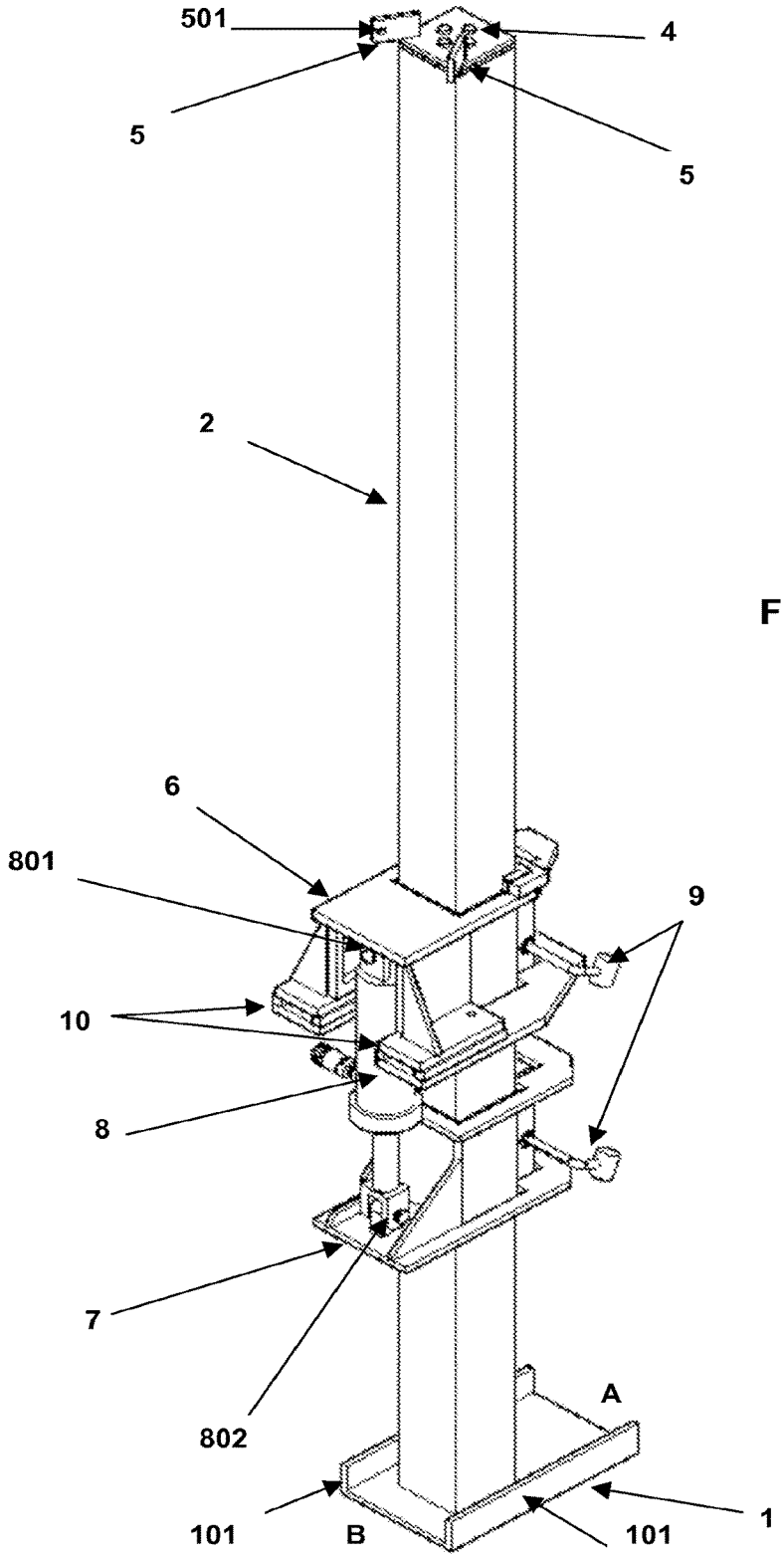
FIG. 1 illustrates a perspective front view of the folding device, object of the present invention.

FIG. 1 shows that the removable device of the present invention, which allows the coupling of accessory supports to fasten various parts of a tank under construction, in a preferred embodiment comprises a pivoted base 1 surface where the jack column 2 is set, and it consists of a rectangular metallic plate folded at 90° at both longer sides, as a upside down "U" shaped tray. These folds 101 at 90° grant the structure resistance and allow the passage of a pivoted shaft 13 (illustrated in FIG. 8).

Near one of the ends of the longer side (rear end A) of said base 1 a perforation of both folds 101 is done on the plate where the pivoted shaft is to pass so that shaft 13 is parallel to the shorter sides of base 1 and that base 1 is able to spin with a center near one of the extremes of the longer sides. Column 2 of the pivoted shaft is not welded centered on base 1 but near one of the shorter sides of the end opposite to the pivoted shafts (front end B), centered regarding the shorter side.

Figure 2:
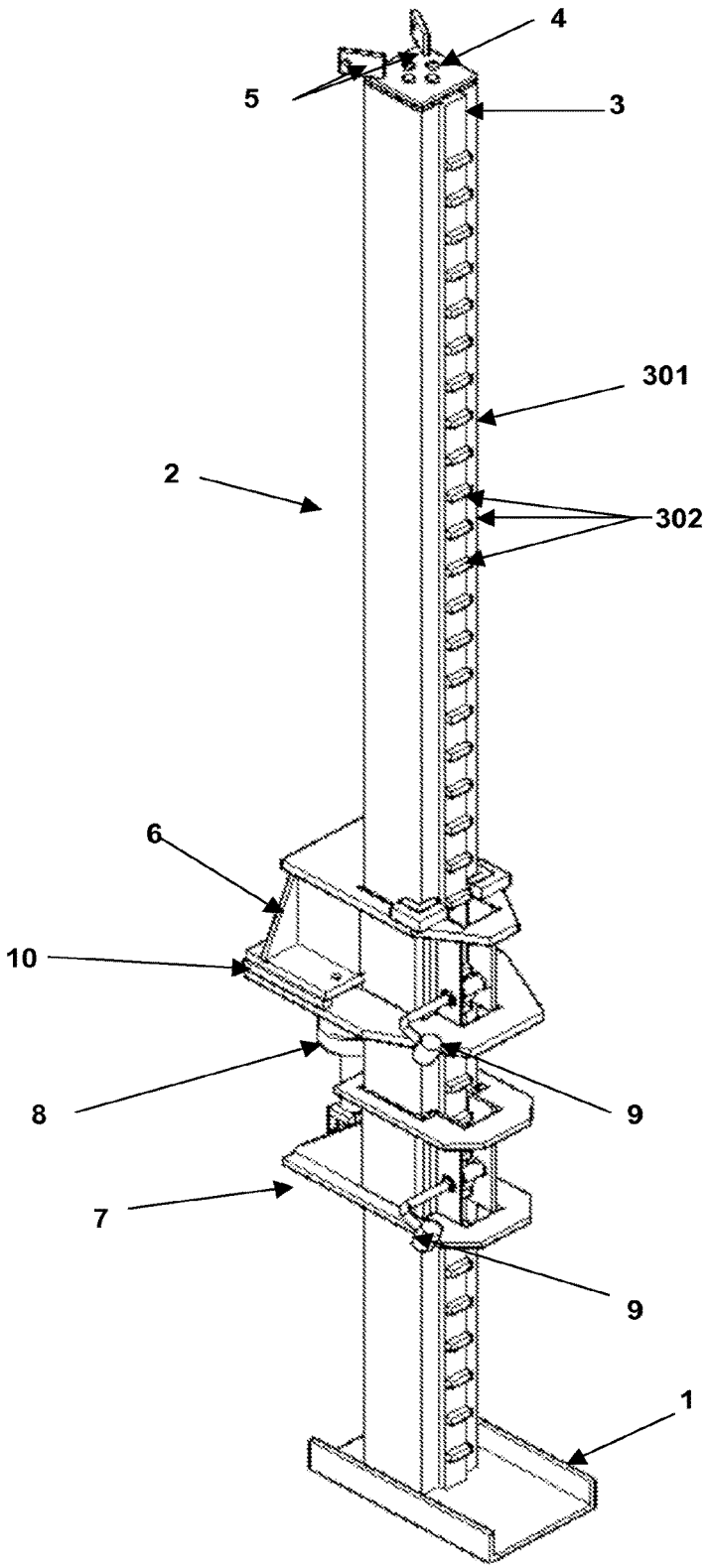
FIG. 2 shows a rear view of the folding device in FIG. 1.

Said column 2 is preferably a hollow metal column of a square section, made of an iron sheet. Its lower end is welded to base 1 and the upper end is covered with a welded plate (of which lateral edges are shown in FIGS. 1 and 2) to column 2. Said plate is perforated so that the stop part and end of run 4 can be screwed. The side close to the pivoted shafts (rear side A) is welded to rack 3, being located centered on the side regarding the vertical shaft of column 2. Said rack 3 consists of a metal plate 301, of the same length of column 2 being the teeth 302 of the rack welded at regular intervals on one of the sides of the plate, consisting said teeth of metal bars of square section, perpendicular to the longer sides of plate 301. The opposite side of plate 301 is welded to the rear side of column 2.

The stop part or body and end of run 4 is formed by a square metallic plate of a slightly longer side than the side of square section of column 2. The supports of the stretchers 5 to 120° regarding the side, one on each corner are welded on the ends of the front side. The stop and end of run 4 is screwed to the cap of column 2, centered regarding said cap of column.

Figure 5:
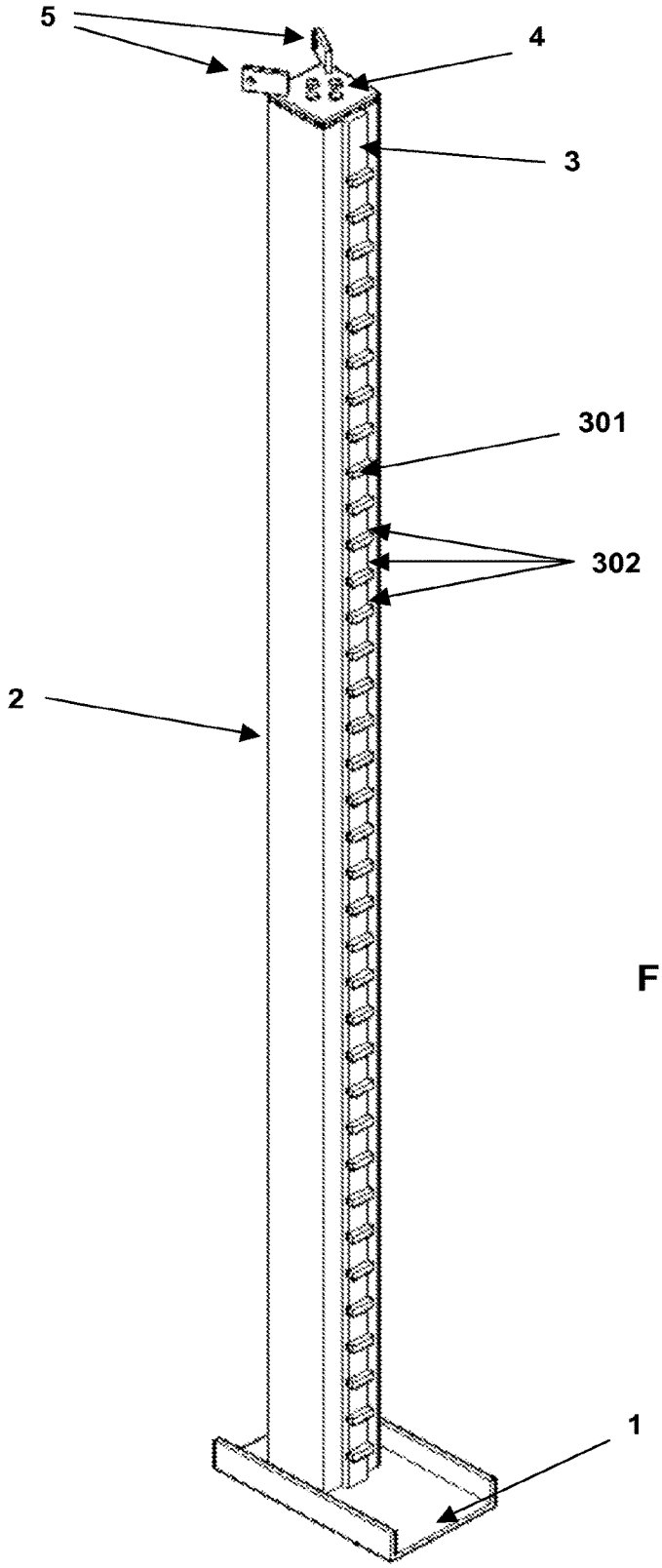
FIG. 5 illustrates a perspective front view of the assembly of the hydraulic folding device of the present invention.

The supporting parts of the stretchers 5, shown in FIGS. 1, 2 and 5, are formed by a short steel plate with a perforation 501 near one of its ends so as to allow securing the stretchers. The supports 5 are welded to the end of run and stop body 4 to one of the longer sides, so that they are perpendicular to said body, and protrude an approximate distance equal to half of its longer side.

Upper box 6 and lower box 7 are assembled along column 2 by means of openings 608 and 701, moving along said column. Said upper box 6 as well as lower box 7 shown in FIGS. 3*a* and 3*b* has a safety lock 9 on the rack side 3 of the column (rear side).

A hydraulic piston 8 joins upper box 6 by means of a shaft 801 which allows one degree of freedom of spinning regarding the shaft perpendicular to column 2, which is located on the front side, opposite the safety lock system 9. The fitting support system 10 together with the hydraulic piston 8 are located on the front side.

Upper box 6 has means to minimize friction when moving along column 2, being said means formed by parts 605 which fit into the "L" shaped corner parts 606. In a preferred embodiment, upper box 6 is made of iron sheet, folded and welded, and the means to minimize friction 605 are rectangular teflon pads arranged as a set square on metal plates square folded 606, located on the corners where the upper box 6 rubs against column 2, two on the upper rear corners and two on the lower front corners.

Figure 4A:
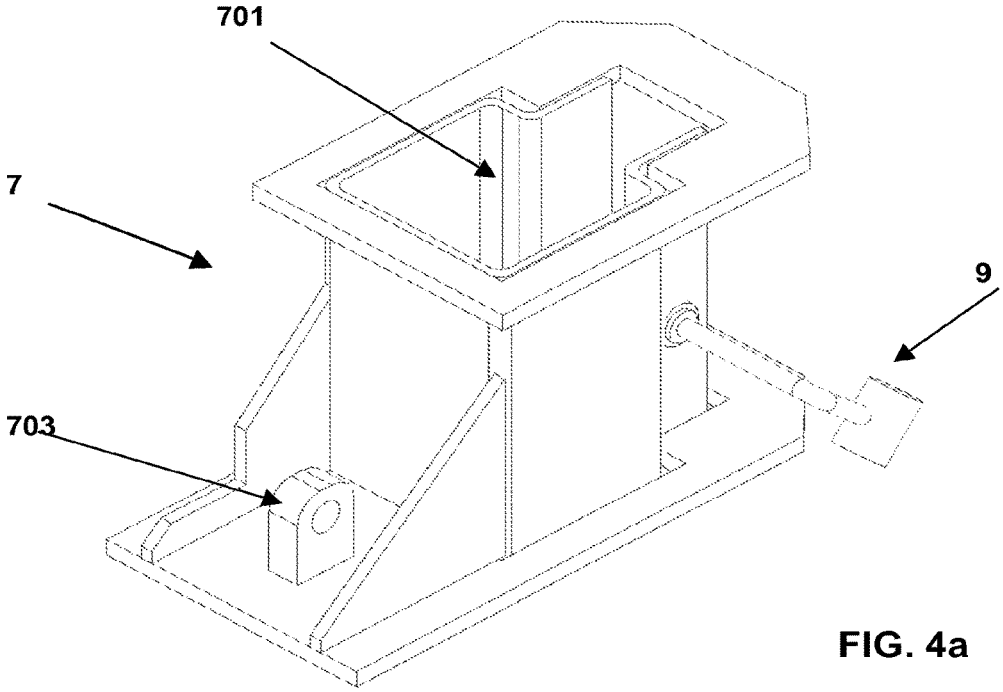
FIG. 4*a* illustrates a perspective front view of the lower box of the folding device in FIGS. 1 and 2.
Figure 4B:
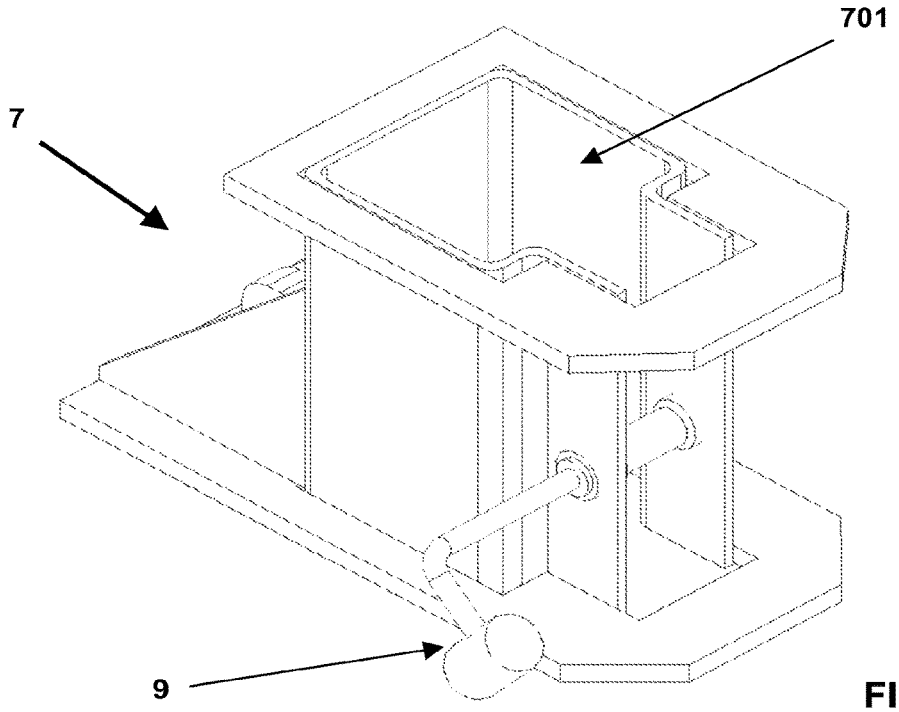
FIG. 4*b* illustrates a perspective rear view of the lower box of the folding device in FIGS. 1 and 2.

Lower box 7, shown in FIGS. 4*a* and 4*b*, as well as upper box 6, has a safety lock 9 on the rack side 3 of the column (rear side), and a support for the hydraulic piston 8 on the opposite side. The hydraulic piston 8 joins lower box 7 by means of shaft 802, which allows one degree of freedom of spinning with the shaft perpendicular to column 2. The lower box 7 is preferably made of iron sheet folded and welded.

Figure 6:
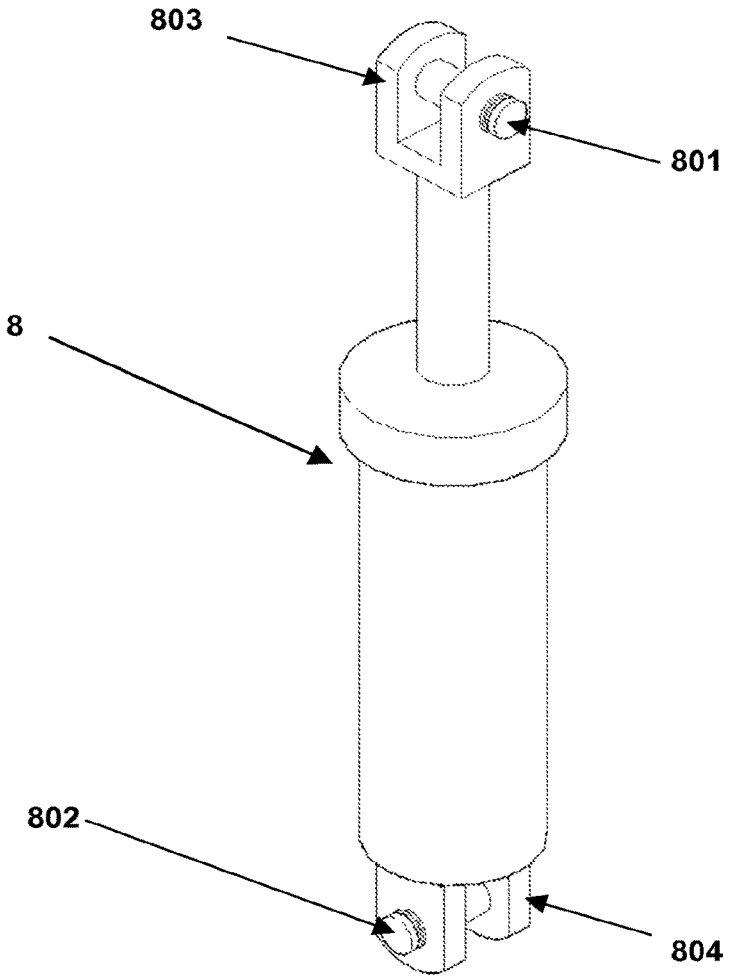
FIG. 6 illustrates a perspective view of the tensile element, preferably a hydraulic piston used in the folding device of the present invention.

Said hydraulic piston 8 shown individually in FIG. 6 is preferably a standard hydraulic piston linking the upper box 6 with the lower box 7 by their ends 803 and 804 linked respectively to bodies 607 and 703 so as to permit two degrees of freedom to compensate for small variations in both upper 6 and lower 7 box verticality.

Regarding safety locks of the upper 6 and lower 7 boxes are preferably standard trigger gravity locks or pawl 901 with balance weight 902 permitting free vertical displacement of the box to the top but avoids displacement to the bottom.

Figure 3A:
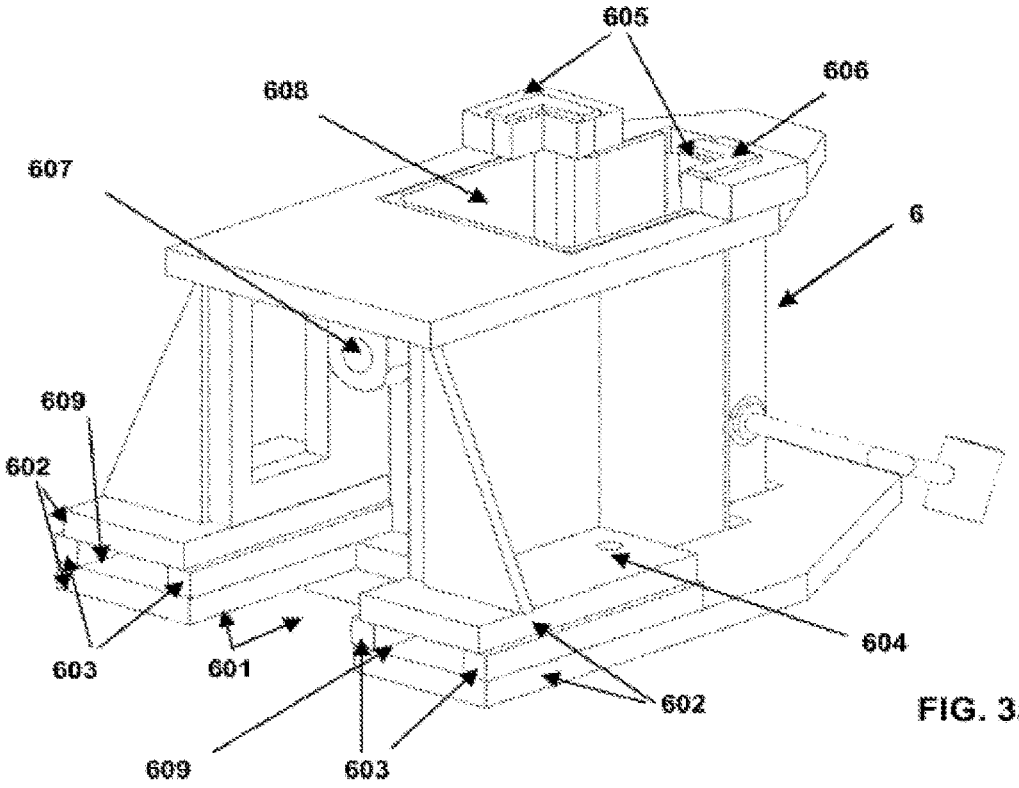
FIG. 3*a* illustrates a perspective front view of the upper box of the folding device in FIGS. 1 and 2.
Figure 3B:
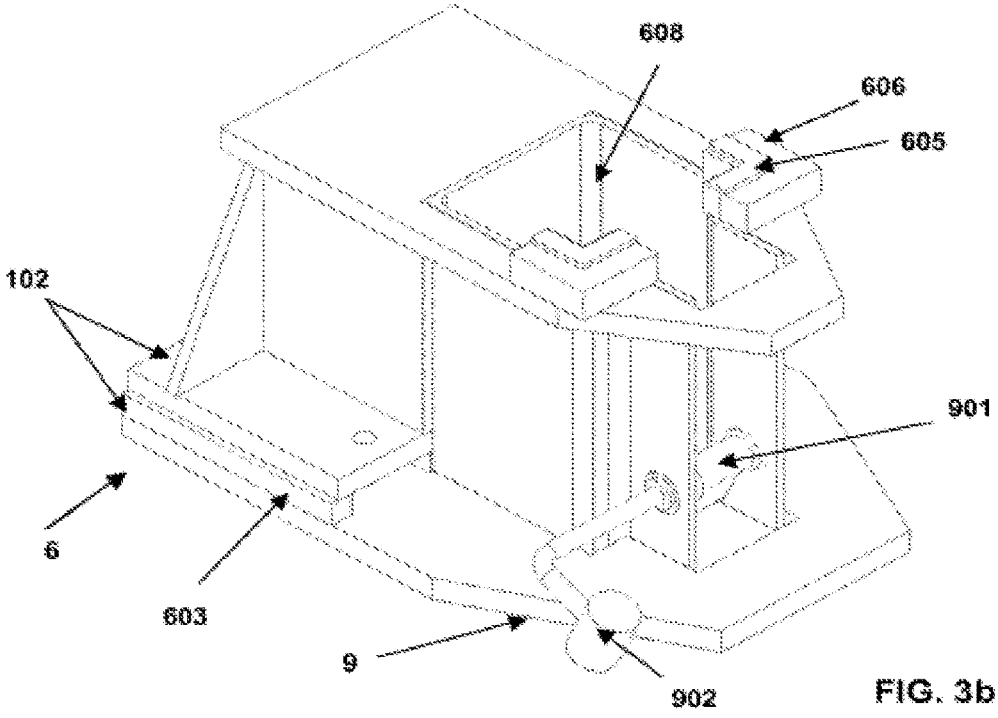
FIG. 3*b* shows a perspective rear view of the upper box of the folding device in FIGS. 1 and 2.
Figure 7:
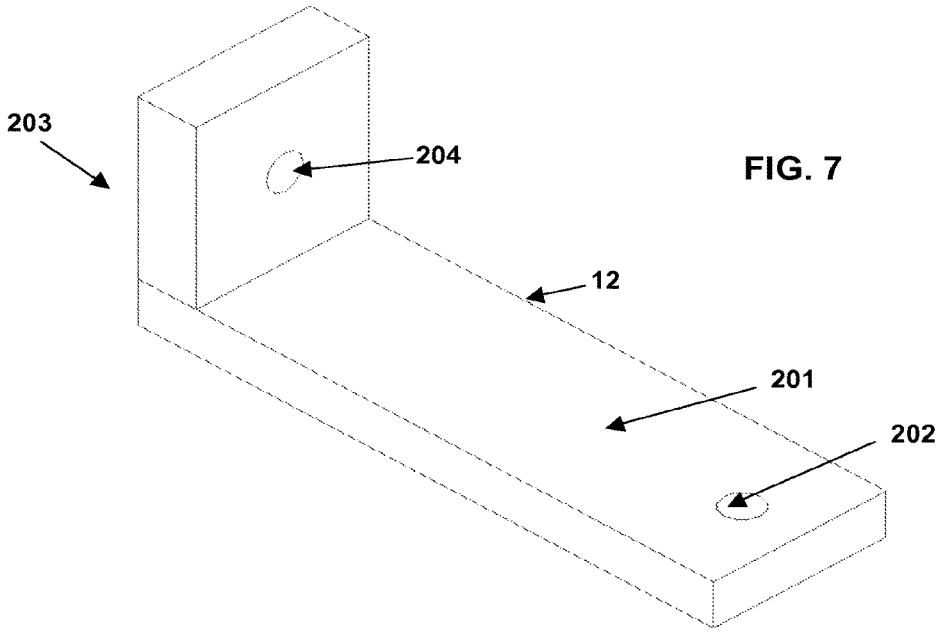
FIG. 7 illustrates a perspective front view of the removable supporting pawls of the folding device of the present invention.

FIGS. 3*a* and 3*b* show the upper box 6 in which the fitting support system 10 is defined comprising two sets of supports 601, each one formed by two horizontal plates 602 separated by two metallic bars with square section 603 so as to leave a space 609 between both plates, which as a kind of "box frame" allow the insertion of a removable fitting 12 shown in FIG. 7. The whole set 602-603 is firmly welded to each other and to the upper box 6 in its front side. Each support 602 has a pass-through perforation 604 near the end, by which a through piece is introduced (not shown), such as a bolt or metallic bar, fixing the removable fitting 12 inserted in each box 609.

The design of said removable fitting 12 will depend on the object to seize and lift, but all of them should have as a common characteristic one or two protrusive plates 201, preferably metallic ones, of the space measures within the fitting support system 10, with a pass-through hole 202 that coinciding with perforation 104 of the fitting support system 10, will enable being locked by a bolt or similar system. These plates should be placed in the removable fitting 12 in the necessary position for the correct location of the removable fitting 12 in the fitting support system 10.

In a preferred embodiment, the removable fitting 12 is a pair of pawls, each one formed by a horizontal plate 201 with a perforation 202 near its end, which will be inserted in one of the "box frames" of the fitting support system 10. In the opposite end, another plate 203 placed at 90° in vertical position has a threaded hole 204 where an adjusting screw is introduced.

Figure 9:
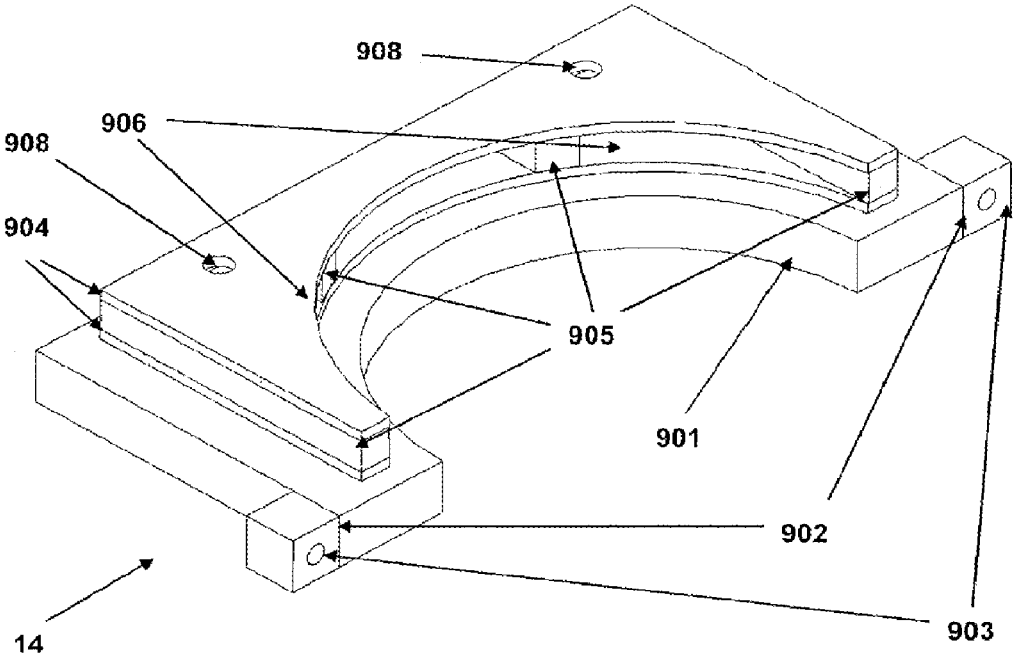
FIG. 9 illustrates a perspective lower view of one of the symmetrical parts constituting the removable supporting flange of the folding device of the present invention.

In another preferred embodiment, the removable fitting 12 is a device of the "fastener" type designed to seize a pipe or vertical cylinder, with two protrusive perforated horizontal plates near its end, which are inserted in the "box frames" 609 of the accessory support system 10. In FIG. 9, a preferred embodiment of this type of fitting can be seen, formed by two equal and opposite plates or parts, each one having a rectangular metallic plate of considerable thickness 901 with a semicircular hole in the middle of one of its longer sides. The two equal and opposite plates or parts have the same diameter that the outside diameter of the vertical pipe may seize. The corresponding supports 902 are welded to the shorter sides, each one with a hole 903 allowing the passage of a bolt (not shown) to link said equal and opposite plates or parts.

In the lower side of each plate of a considerable thickness 901 a device is welded. Said device is formed by two equal rectangular plates 904 of a smaller size than the plate of considerable thickness 901, each with a semicircular hole in the middle of one of its longer sides, separated by four metal bars of a square section 905 so as to form two "box frames" 906 of an equal geometry of the "box frames" of the fitting support system 10, being the whole set firmly welded. Two passing perforations 907 in each part allow securing by means of bolts or other similar system the corresponding horizontal plates with a perforation near each end, which will be inserted in the "box frames" of the fitting support system 10 and the "box" of the "fastener" type device 906 thus attaching the removable fitting "fastener" type to the fitting support system 10 of one or two folding devices of the present invention facing one another, according to the required weight to lift.

Changing the geometry of the plates of considerable thickness 901 it is possible to adapt this removable fitting to seize different types of objects to be lifted.

Figure 8:
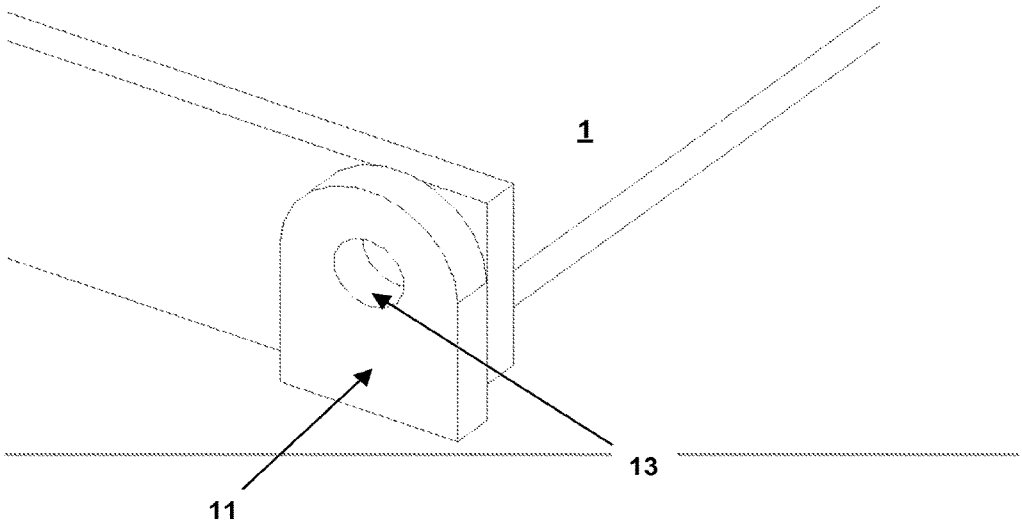
FIG. 8 is a detail of a wing attached to the base so as to allow the spinning of the column of the folding device of the present invention.

Finally, FIG. 8 shows wings 11 that allow the spinning of column 2. Both wings 11 welded to each lateral of base 1 is formed by a perforated iron plate which allows the passage of shaft 13 that links them to the pivoted base 1 welded or fixed to the floor, one at each side of the pivoted base 1 and allows the spinning of the folding device.

The folding device of the present invention is located on the chosen site so that its front side faces the object to be lifted, at a suitable distance from said object for the proper operation of the removable fitting 12 used to seize the object to be lifted.

In a preferred embodiment, the removable fitting 12 is a metallic "pawl" designed to seize a metallic plate by its lower edge. In another preferred embodiment, the removable fitting 12 is a metallic device designed to seize cylindrical parts with a fastener at the end, such as sections of a column.

The folding device is firmly anchored to the floor, thus fixing to this purpose the wings 11 for the spinning of column 2 and the stretchers (not illustrated) on the one hand to the floor and on the other hand to the supporting bodies of the stretchers 5 located on the stop and end of run part 4 of column 2. In a preferred embodiment the folding device is placed on a metal floor and the attachment of the wings 11 as well as of the stretchers ends to the floor is achieved by welding.

The following step is to connect the hydraulic system that actuates the hydraulic piston 8. In a preferred embodiment, the hydraulic system is driven by a central unit ruling and coordinating a multiplicity of similar folding devices that work together as a set to lift a structure.

They move by actuating the hydraulic cylinder 8, the upper 6 and lower 7 boxes so that said cylinders remain in the closest position, and at a suitable height to place the removable fitting 12 attached to the object to be lifted. The removable fitting 12 is placed inside the cavities of the fitting support system 10 and they are locked by means of a pin, bolt or similar system.

In a preferred embodiment, both boxes 609 are placed in their corresponding positions closest to the floor, and the removable fitting 12 used is a pair of "pawls" that fasten a vertical plate by its lower end.

It is verified that the trigger of the safety lock 9 of the lower box 7 is correctly assembled to lock said box.

The hydraulic piston 8 is then activated. Said piston tends to separate both boxes 609, pushing lower box 7 downwards and upper box 6 upwards, which due to the safety lock 9 makes the upper box 6 move upwards, thus moving at the same time the structure attached by the removable fitting 12 attached to the fitting support system 10.

In a preferred embodiment, a multiplicity of hydraulic folding devices actuated as a whole lifts a structure of considerable dimensions.

In a preferred embodiment, the structure of considerable dimensions is a metal tank under construction, held and lifted by the lower edge of the lower ring and the lower ends of the internal columns by means of a multiplicity of folding devices of the present invention:

Once at the maximum stretching point of the hydraulic piston 8, it is verified that the trigger of the safety lock 9 of the upper box 6 is properly assembled to lock it, and the hydraulic piston 8 is returned, which tends to pull both boxes together, pushing lower box 7 upwards and upper box 6 downwards. Lower box 7 moves upwards due to the safety lock 9 that immobilizes upper box 6.

In a preferred embodiment, a multiplicity of hydraulic jacks that lift a structure of considerable dimensions are actuated as a set to cause pistons to return coordinately.

The process of verification of the proper lock of the lower box 7, activating the hydraulic piston 8 to lift the upper box 6 and the structure held by means of said piston using lower box 7 as a supporting point, verifying the proper lock of upper box 6 and returning hydraulic piston 8 to lift lower box 7 is repeated the number of times required to lift the structure to the desired height or until upper box 6 reaches the stop and end of run 4 located at the upper end of the riser.

In a preferred embodiment, in the construction process of a metal tank of considerable dimensions the roof of the tank attached to one or more rings is lifted by means of this system held by the lower edge of the lower ring up to a proper height so as to allow the insertion of a new lower ring. In this embodiment, the sheets constituting the new ring are placed in position and separated in a uniform manner regarding the upper ring by means of spacers, the thickness of which is slightly greater than the thickness of the supporting "pawls" inserted in the accessory support system 10 of the hydraulic folding device.

Once the lifted structure is placed in position, it is proceeded to disassemble and remove the removable fittings 12.

In a preferred embodiment described above, the "pawls" are removed leaving the tank resting on the spacers of the new ring.

The stretchers which hold the removable fitting by means of the stretcher supports are released and said fitting is removed by rotating it on the shaft of its pivoted base 1.

In the preferred embodiment described above, the folding device is folded at 90°.

The easiness provided by the folding device design to remove the removable fittings 12 and to be folded, allows the free access to the surface of the structure under construction by operators and tools, preventing the folding device from becoming an obstacle.

In the preferred embodiment described above, an automatic welding system is placed, which moves along the ring under construction, welding it to the upper ring.

In a preferred embodiment, a multiplicity of folding devices that lift a structure of large dimensions coordinately are folded sequentially to allow the passage of a welding robot over the whole surface of the structure under construction. In a preferred embodiment, this surface is a ring of a cylindrical tank under construction.

Once the works on the structure are finished, and if required by the process, the jack is placed again in vertical position, the stretchers to hold the folding device by means of stretcher supports are restored, and the structure lifting process is repeated.

In the preferred embodiment mentioned above, the process is repeated until the total number of desired rings is added to the tank of considerable dimensions, and the structure is then placed on the tank floor.

To conclude, the folding device is disassembled and removed.

In a preferred embodiment, the wings 11 are cut to allow the column to spin and wings 11 for the anchorage of the stretchers welded to the floor and the metal surface of the floor is trimmed to obtain a neat finish.

With the folding device claimed in this invention the operation following the jack disassembly is minimized, being reduced to just dewelding four small fittings on the structure floor.

What is claimed is:

1. A folding lifting device to be used in the construction of large metal tanks, comprising a column (2) on which respective upper (6) and lower (7) bodies are so they can move along the column (2), said upper and lower bodies (6 and 7) are linked by each other by means of a tensile element (8), and said upper (6) and lower (7) bodies having a means for locking or fixing (9) to said column (2); being said column (2) assembled in a pivot way with respect to a base (1) and said upper body (6) having a housing (609), for insertion therein of a removable fitting (112), wherein said means for locking or fixing (9) comprise a pawl or tooth (901) configured to fit on at least one tooth of a rack (3) formed on said column (2).

2. The folding lifting device to be used in the construction of large metal tanks, according to claim 1 wherein on said column (2) stretcher support means (5) are defined, and where said stretcher support means comprise two plates located at 120° with respect to each other, one on each of two corners of a top and end of run squared plate (4) arranged on an end of said column (2) opposite to said base (1).

3. The folding lifting device to be used in the construction of large metal tanks according to claim 1 wherein said upper body (6) is an upper box (6) which comprises an opening (608), able to permit the passage of the column (2) and a fitting supporting system (10) comprising two support sets (601), each formed by two horizontal plates (602), separated by two metallic bars of a square section (603), leaving a space or box frame (609) between both plates to unable to accommodate insertion of a removable fitting (12); being the whole set (602-603) firmly welded and welded to the upper box (6) in a front side; and where each support (602) has a pass-through perforation (604) near an end able to receive a means for fixing which holds the removable fitting (12) inserted in the space or box frame (609).

4. The folding lifting device to be used in the construction of large metal tanks, according to claim 1 wherein said lower body (7) comprises an opening (701) able to permit the passage of the column (2).

5. The folding lifting device to be used in the construction of large metal tanks, according to claim 1 wherein said tensile element (8) is a hydraulic cylinder with the corresponding shafts (801, 802) to couple respectively with the upper (6) and lower (7) body.

6. The folding lifting device to be used in the construction of large metal tanks, according to claim 1 wherein said upper body (6) and said lower body (7) are, respectively, an upper box (6) and a lower box (7) which comprise means for minimizing friction during motion along said column (2), said means for minimizing friction being formed by Teflon parts (605) which fit in "L"-shaped corner parts (606), located: two on back upper corners and two on the front lower corners of said boxes (6,7).

7. The folding lifting device to be used in the construction of large metal tanks, according to claim 1 wherein said base (1) comprises a rectangular metallic plate folded to 90 degree on both longer sides, as an inverted "U" tray; where in one of the ends of the longer sides (A) of said base (1) a perforation is made in both folds (101) of the plate able to receive a pivoting shaft (3) linked to wings (11), so as to enable pivoting of said base (1).

8. The folding device to be used in the construction of large metal tanks, according to claim 3 wherein said removable fitting (12), comprising a pair of pawls, each formed by a horizontal plate (201) with a perforation (202) at a free end of the horizontal plate (201), the horizontal plate (201) being inserted in one of a plurality of box frames of the fitting supporting system (10) and at an end opposite to said free end, another plate (203) arranged vertically at 90° with respect to said horizontal plate (201), with a threaded hole (204) into which an adjusting screw is introduced.

9. A removable fitting applicable to a folding lifting device, comprising at least two equal and opposite linkable parts (14), each one formed by a whole set that includes two rectangular horizontal plates (904) with a semicircular perforation in a middle of one of its longer sides of the two rectangular horizontal plates (904), separated by four metal bars having a square section (905), so as to leave two spaces or boxes (906) between both plates for insertion of a respective horizontal plate with a perforation spaced from ends in each one of the spaces or boxes (906), said horizontal plates in turn inserted in each box frame (609) of the fitting supporting system (10), and the whole set being firmly welded to a rectangular and horizontal plate (901) with a semicircular perforation in the middle of one of longer sides of the rectangular and horizontal plate (901), but of a larger size than each of the rectangular horizontal plates, two supports (902) welded at shorter sides of the rectangular and horizontal plate (901), each one with a pass-through perforation (903) enabling passage of a bolt to fix said at least two equal and opposite linkable parts (14) to each other; and each of said equal and opposite linkable parts (14) being provided with two pass-through perforations (908) configured to fix thereto said horizontal plates.

* * * * *